US007296653B1

(12) United States Patent
Smith, Jr. et al.

(10) Patent No.: US 7,296,653 B1
(45) Date of Patent: Nov. 20, 2007

(54) SOUND CONTROL APPARATUS

(76) Inventors: Harold N. Smith, Jr., 3411 Loblolly La., Spring, TX (US) 77380; Harold N. Smith, III, 3411 Loblolly La., Spring, TX (US) 77380

( * ) Notice: Subject to any disclaimer, the term of this patent is extended or adjusted under 35 U.S.C. 154(b) by 147 days.

(21) Appl. No.: 11/031,775

(22) Filed: Jan. 7, 2005

Related U.S. Application Data

(60) Provisional application No. 60/535,992, filed on Jan. 12, 2004.

(51) Int. Cl.
*A47B 81/06* (2006.01)
*A47G 29/00* (2006.01)

(52) U.S. Cl. ..... 181/155; 181/198; 181/199; 381/334; 381/335; 381/336; 381/325; 248/370; 248/371; 84/327; 84/280

(58) Field of Classification Search ..... 181/155, 181/156, 198, 199, 287, 30; 381/334, 335, 381/336, 337, 345, 160; 211/85.6; 84/327, 84/280; D14/210, 211, 212
See application file for complete search history.

(56) References Cited

U.S. PATENT DOCUMENTS

| | | | | | |
|---|---|---|---|---|---|
| 2,804,933 | A * | 9/1957 | Imhof | 181/141 |
| 3,032,137 | A * | 5/1962 | Rice | 181/199 |
| 3,057,591 | A * | 10/1962 | Weimer | 248/166 |
| 3,232,370 | A * | 2/1966 | Jaffe | 181/30 |
| 3,908,787 | A * | 9/1975 | Wenger et al. | 181/30 |
| 4,278,145 | A * | 7/1981 | Eade et al. | 181/30 |
| 4,515,238 | A * | 5/1985 | Baker | 181/30 |
| 4,596,305 | A * | 6/1986 | Jagborn | 181/151 |
| 4,753,408 | A * | 6/1988 | Wailes | 248/371 |
| 5,024,407 | A * | 6/1991 | Bartley | 248/164 |
| 5,161,771 | A * | 11/1992 | Domeier | 248/676 |
| 5,190,254 | A * | 3/1993 | Maguire | 248/164 |
| 5,383,634 | A * | 1/1995 | Liao | 248/166 |
| 5,651,405 | A * | 7/1997 | Boeddeker et al. | 160/135 |
| 5,973,244 | A * | 10/1999 | McCulloch | 84/327 |
| 6,085,861 | A * | 7/2000 | Jines | 181/30 |
| 6,145,801 | A * | 11/2000 | Herring, Jr. | 248/463 |
| 6,349,792 | B1 * | 2/2002 | Smith et al. | 181/156 |
| 6,412,742 | B1 * | 7/2002 | Yu | 248/434 |
| 6,520,282 | B1 * | 2/2003 | Hadzic et al. | 181/199 |
| 6,584,736 | B2 * | 7/2003 | Szymanski et al. | 52/145 |
| D482,904 | S * | 12/2003 | Slaymaker | D6/466 |
| 2002/0118853 | A1 * | 8/2002 | Flentje | 381/336 |

* cited by examiner

*Primary Examiner*—Lincoln Donovan
*Assistant Examiner*—Jeremy Luks
(74) *Attorney, Agent, or Firm*—William W. Haefliger

(57) ABSTRACT

A sound controlling apparatus adapted for combination with a speaker unit, comprising a stand configured to support the speaker unit, a reflecting panel or panels associated with the stand to reflect sound waves transmitted by the speaker unit, a side panel or panels associated with the stand, there being a reflected sound transmission path or paths defined by at least one of the following:

i) the stand
ii) a side panel, or panels,
iii) the stand and a side panel or panels.

9 Claims, 14 Drawing Sheets

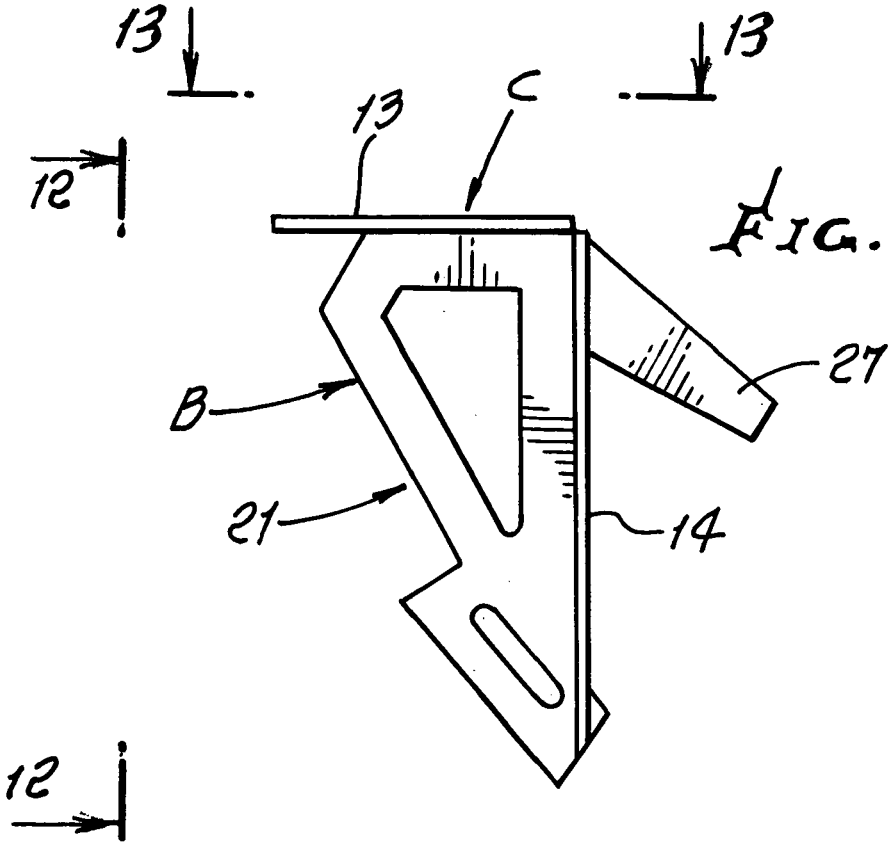
FIG. 11.
FIG. 12.
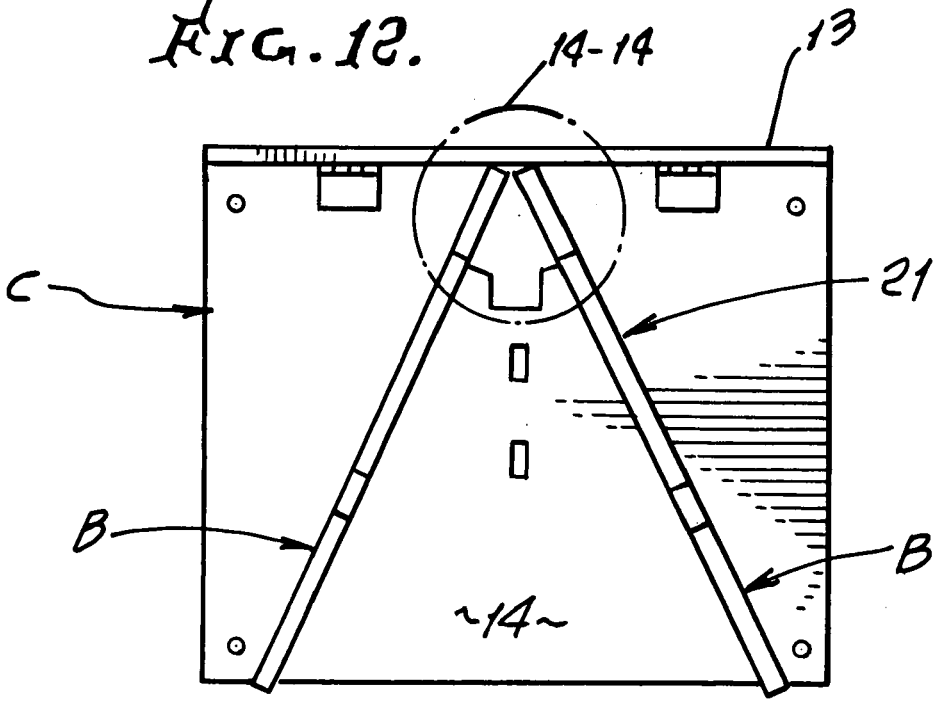

SOUND CONTROL APPARATUS

BACKGROUND OF THE INVENTION

This application claims priority from provisional application Ser. No. 60/535,992, filed Jan. 12, 2004.

This invention relates generally to the field of loud speaker equipment, and/or speaker and amplifier assemblies, and more particularly to enhancement of sound produced by such equipment or assemblies. The invention provides for reflection and control of the travel path or paths of such produced sound, whereby control of ultimate sound effect is realized. Collapsible apparatus for achievement of such sound control is provided, facilitating portability.

SUMMARY OF THE INVENTION

It is a major object of the invention to provide a collapsible sound controlling apparatus easily combined with a speaker unit, and that incorporates a) a stand configured to support the speaker unit, b) a reflecting panel or panels associated with the stand to reflect sound waves transmitted by the speaker unit, c) a side panel or panels associated with the stand, d) there being a reflected sound transmission path or paths defined by at least one of the following:

i) the stand ii) a side panel, or panels, iii) the stand and a side panel or panels.

Another object is to provide a stand that includes two generally upright panel sections, with upper edges configured to support the speaker unit, said stand panel sections spaced apart to define a reflected sound transmission path therebetween. Those sections typically have support legs, and through openings to transmit sound sidewardly between at least two of said transmission paths.

A further object is to provide the reflecting panel or panels to include a first reflecting panel to reflect sound waves directly directed at the first panel, and a second reflecting panel to reflect sound waves reflected from the first panel.

Additional objects include provision of a central brace to assist in assembly stability; and side panels carried to reflect or direct sound transmission at sides of a transmission channel, but also allowing upward sound travel, about the speaker unit.

DRAWING DESCRIPTION

FIG. 11 is an edge view, like FIG. 9 of the reflecting panels C, assembled to a stand panel section B;

FIG. 12 is a top plan view taken on lines 12-12- of FIG. 11, and showing two stand panel sections B assembled in angled relation to reflecting panels C;

DETAILED DESCRIPTION

Figure 4:
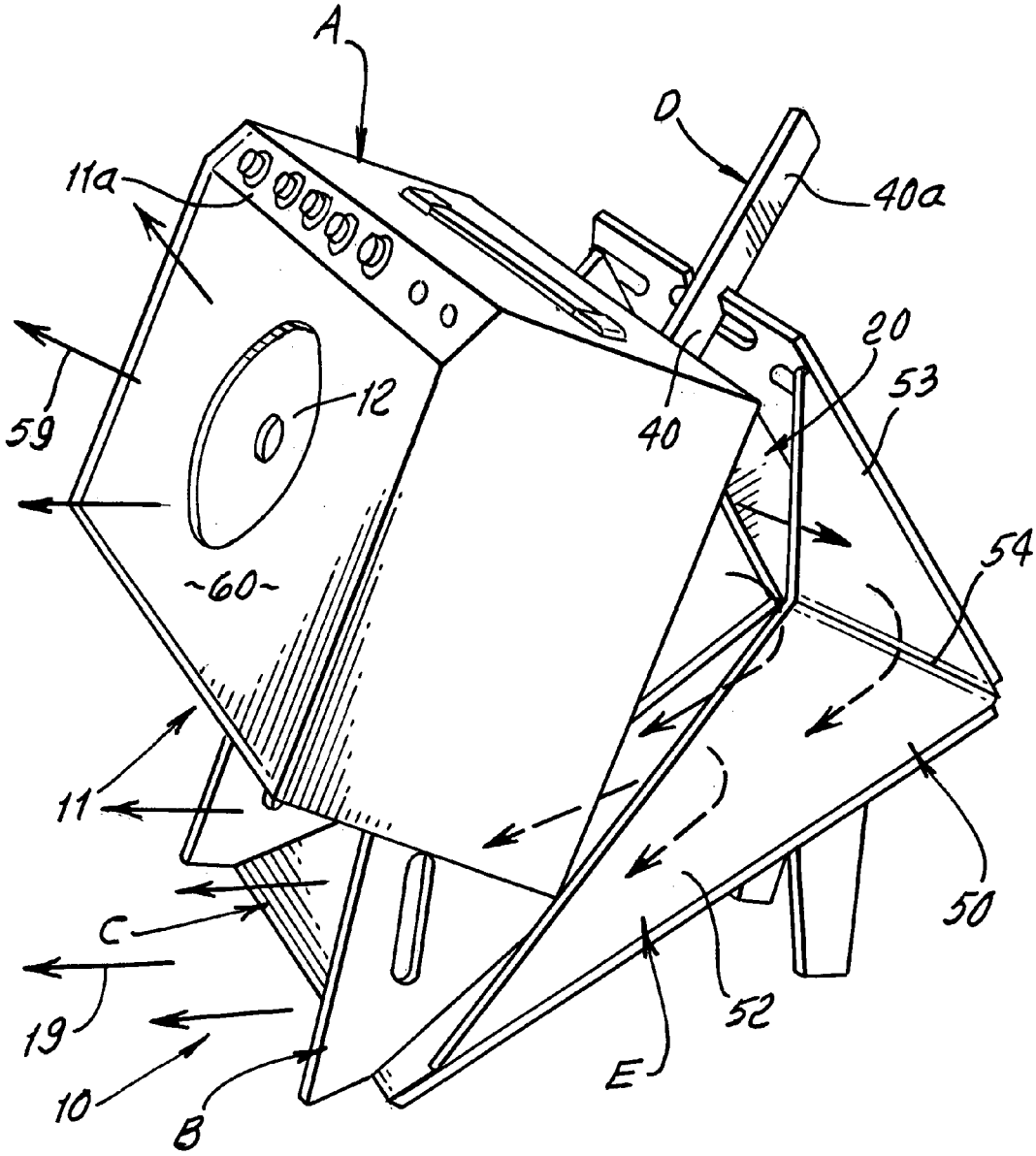
FIG. 4 is a view like FIG. 3, but also showing arrows indicating sound travel paths.
Figure 5:
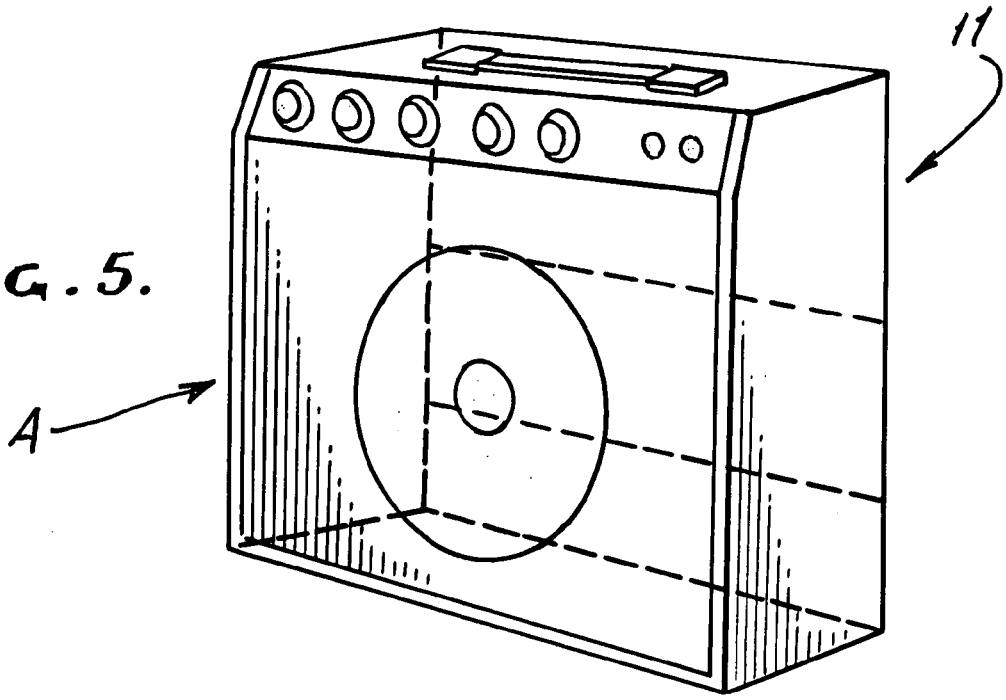
FIG. 5 is a perspective view of a typical speaker amplifier unit, with broken lines indicating rear construction.
Figure 6:
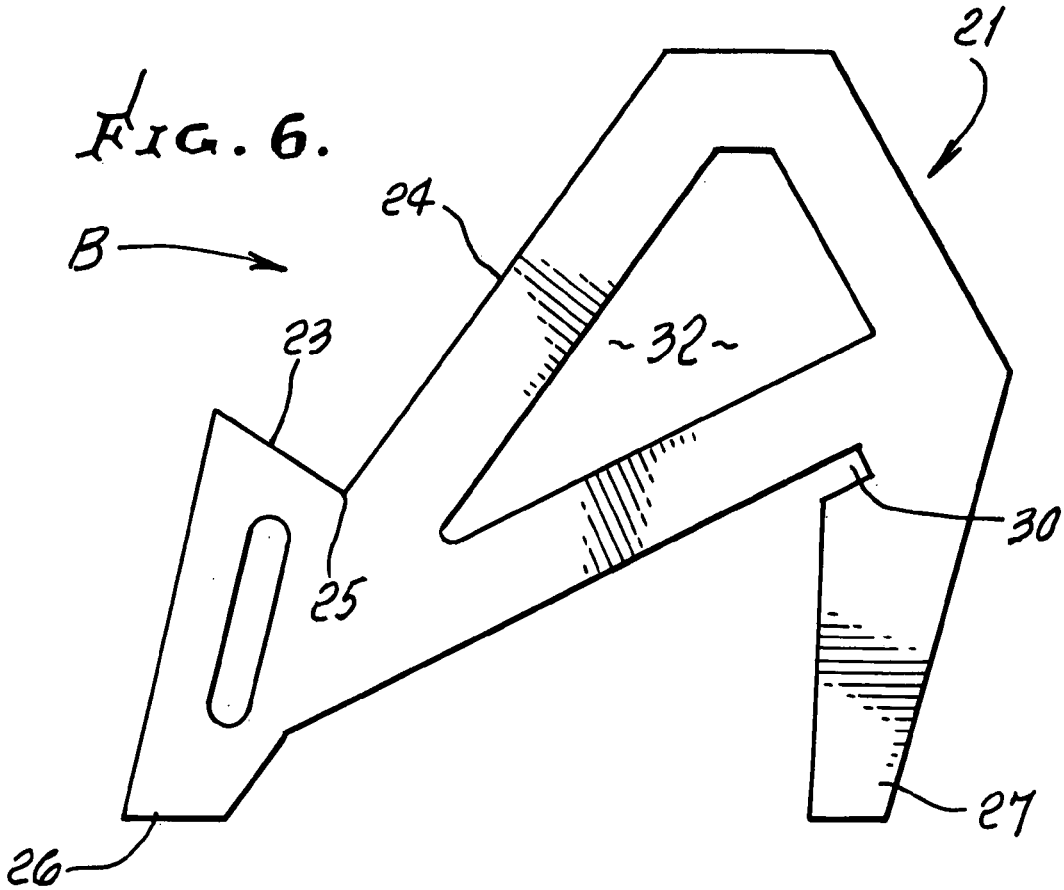
FIG. 6 is a side view of a stand upright panel section B, there being two such panel sections employed in the apparatus seen in FIG. 1.
Figure 7:
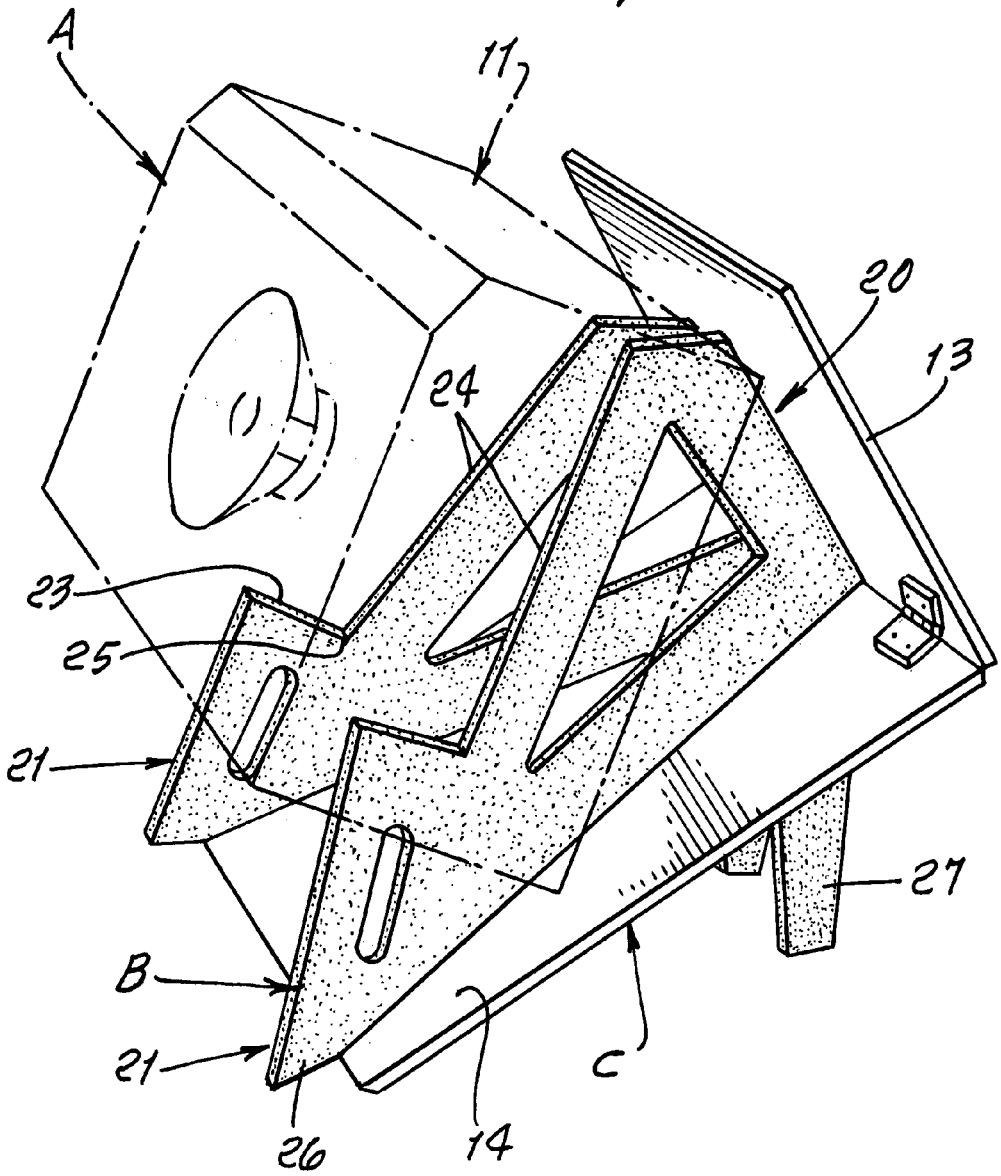
FIG. 7 is a perspective view showing the two upright stand panel sections, as installed, in shaded form.

FIGS. 1-24 show the panels B, C and E, and the brace D, in relation to the speaker, or speaker and amplifier unit A that produces sound waves to be reflected, and to travel as seen in FIG. 4. The construction allows easy folding of components, and stacking, for transport. See also controls 11*a* for 11.

Figure 8:
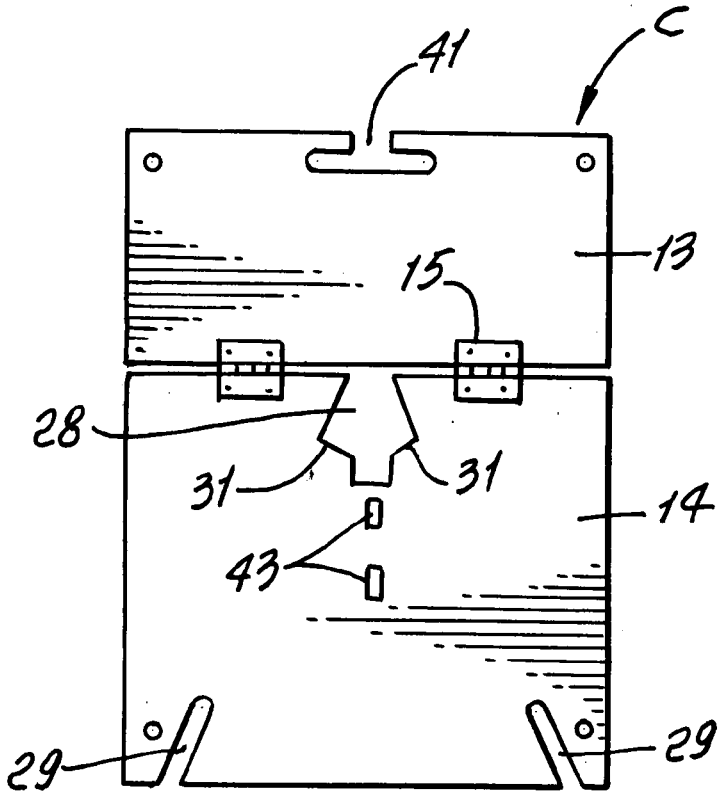
FIG. 8 is a frontal view of two sound reflecting panels designated at C, as used in FIG. 1, such panels hinged together to fold as when the apparatus is to be transported.
Figure 9:
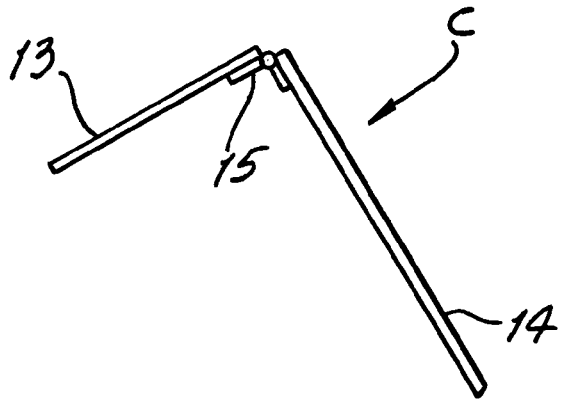
FIG. 9 is an edge view of the two sound reflecting panels of FIG. 8, and in partly folded condition, as installed in the FIG. 1 apparatus.
Figure 10:
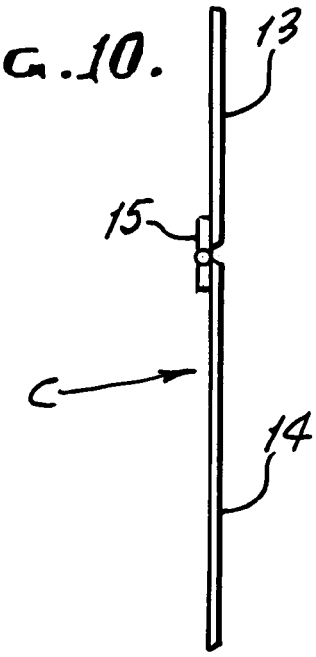
FIG. 10 is an edge view of the two sound reflecting panels of FIG. 8 in completing unfolded condition.
Figure 13:
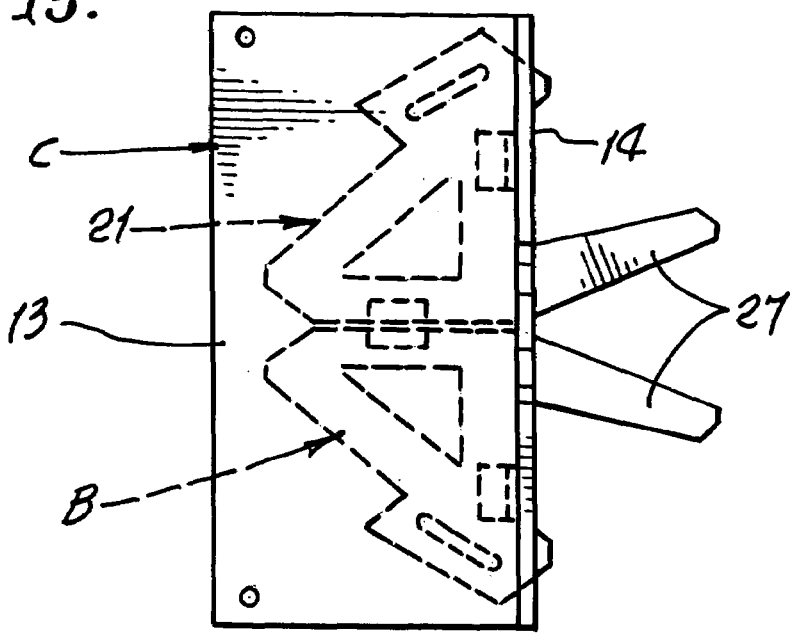
FIG. 13 is an elevation view taken on lines 13-13 of FIG. 11.
Figure 14:
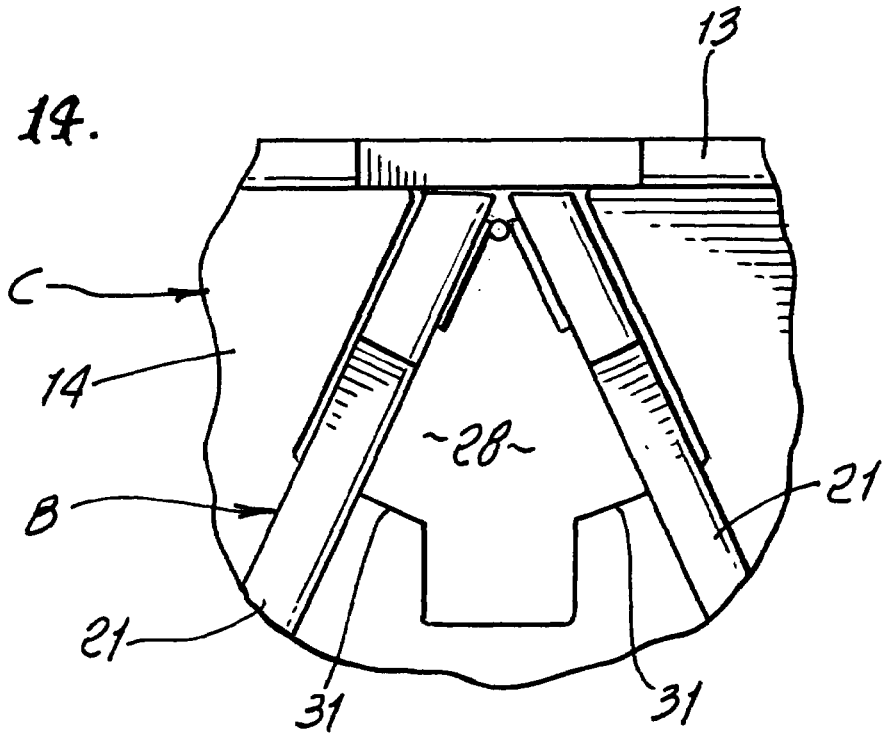
FIG. 14 is a fragmentary enlarged view taken on lines 14-14 of FIG. 12.
Figure 15:
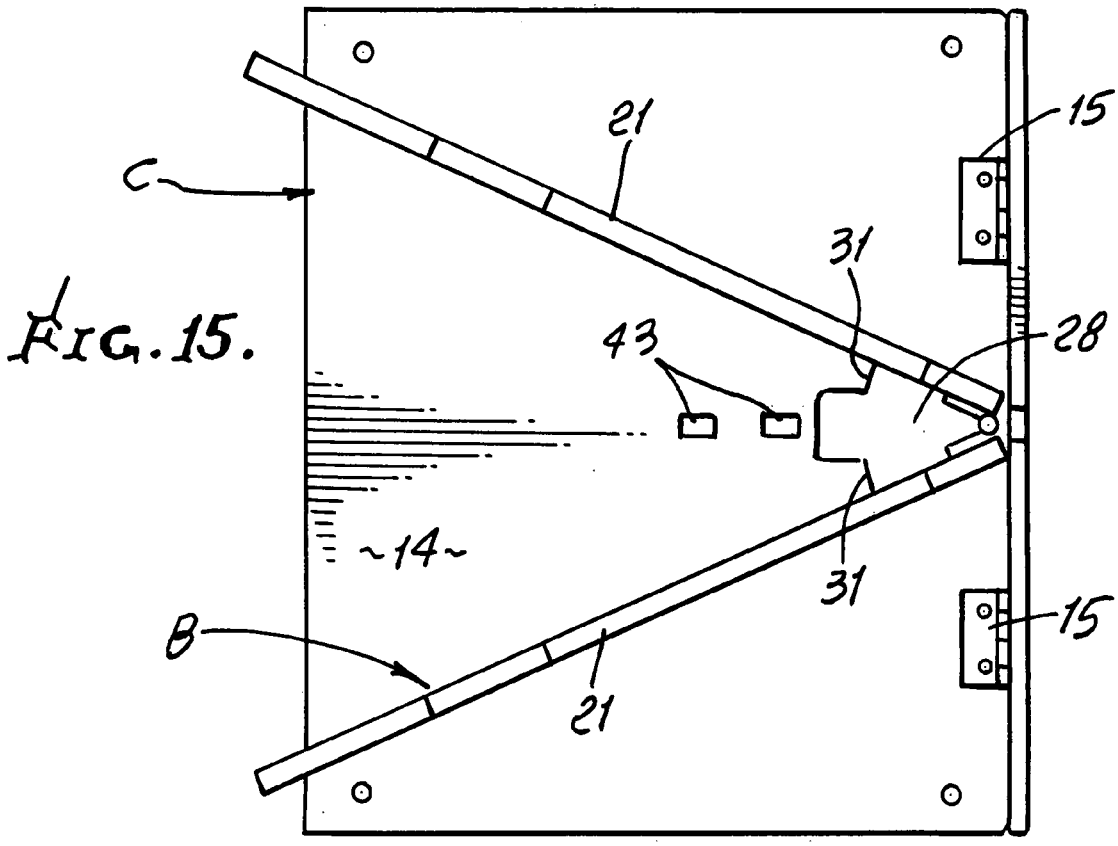
FIG. 15 is an enlarged view, like FIG. 12, showing hinge connection of the two upright stand panel sections at their converging ends proximate the sound reflecting surface of one of the two sound reflecting panels.
Figure 16:
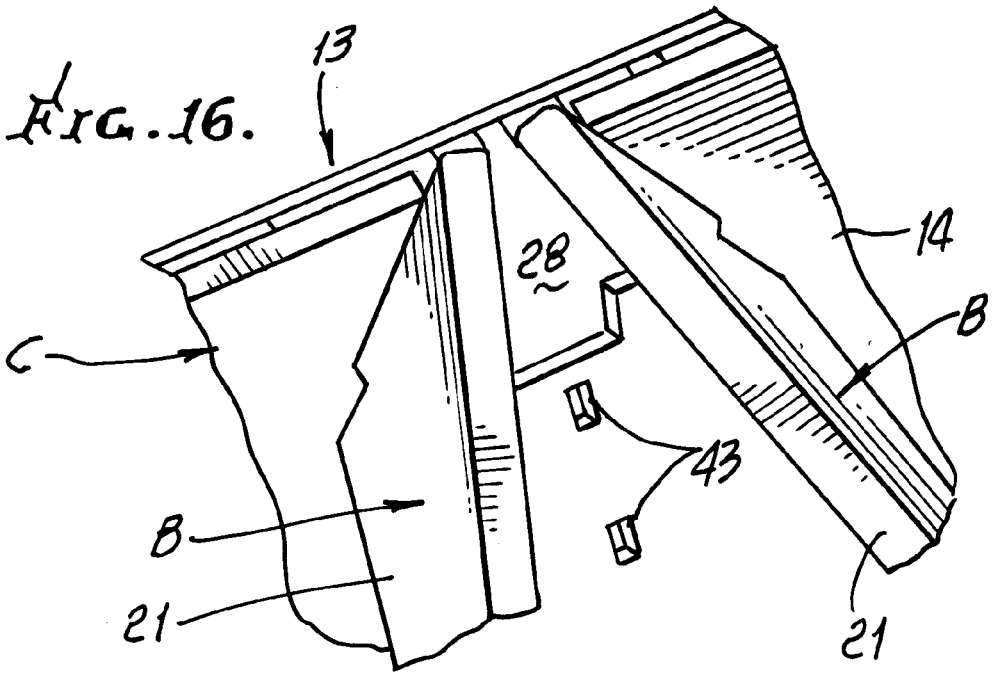
FIG. 16 is a bottom view of panels B and C, showing intersection locations.
Figure 18:
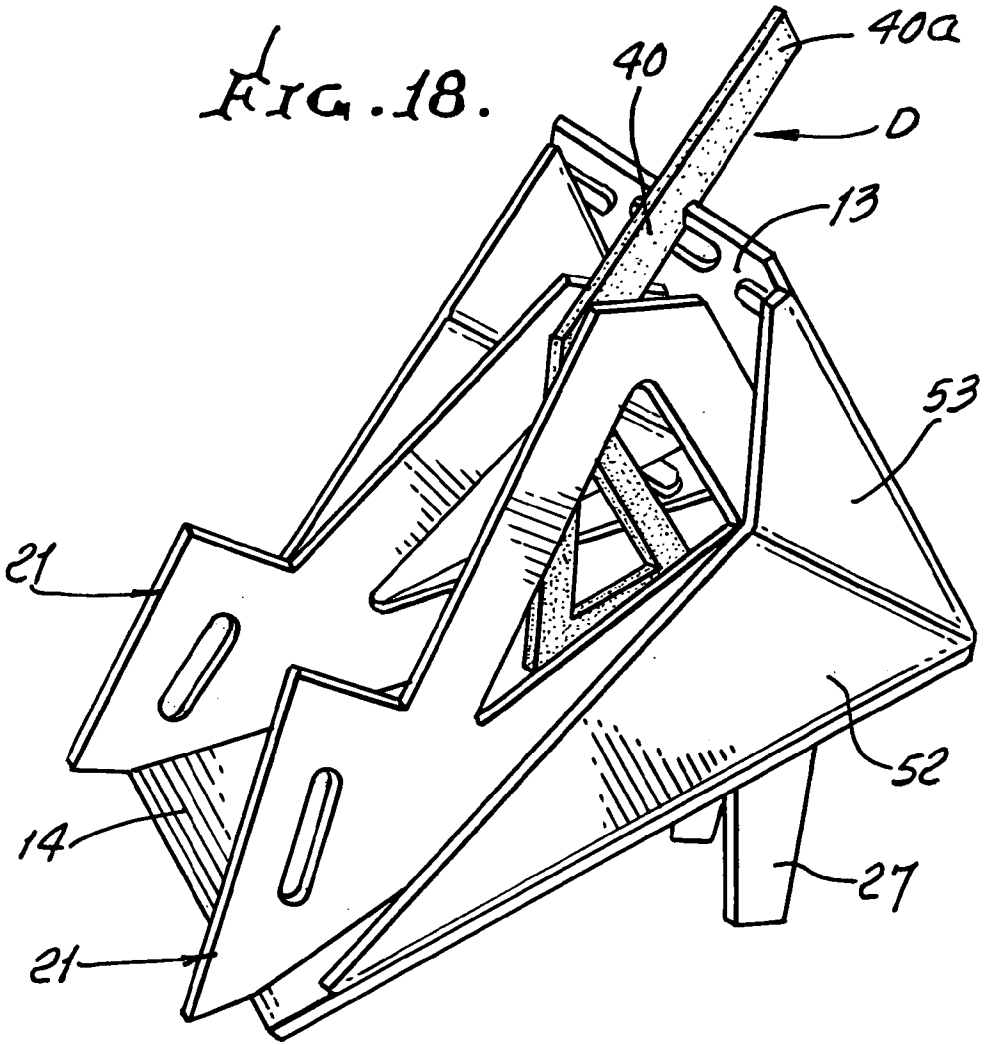
FIG. 18 is a view like FIG. 1 showing the brace D in shaded configuration, as installed in the assembly of panels shown in FIG. 1.
Figure 17:
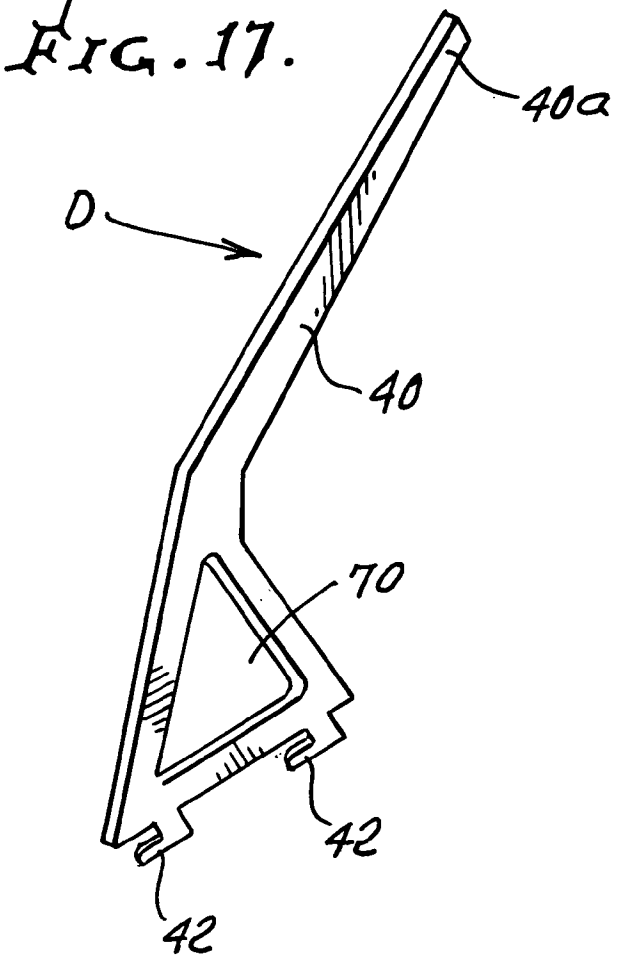
FIG. 17 is a perspective view of a brace D for the stand to be employed as seen in FIG. 1, between stand panel section B, and to intersect a reflecting panel section in FIG. 1.
Figure 19:
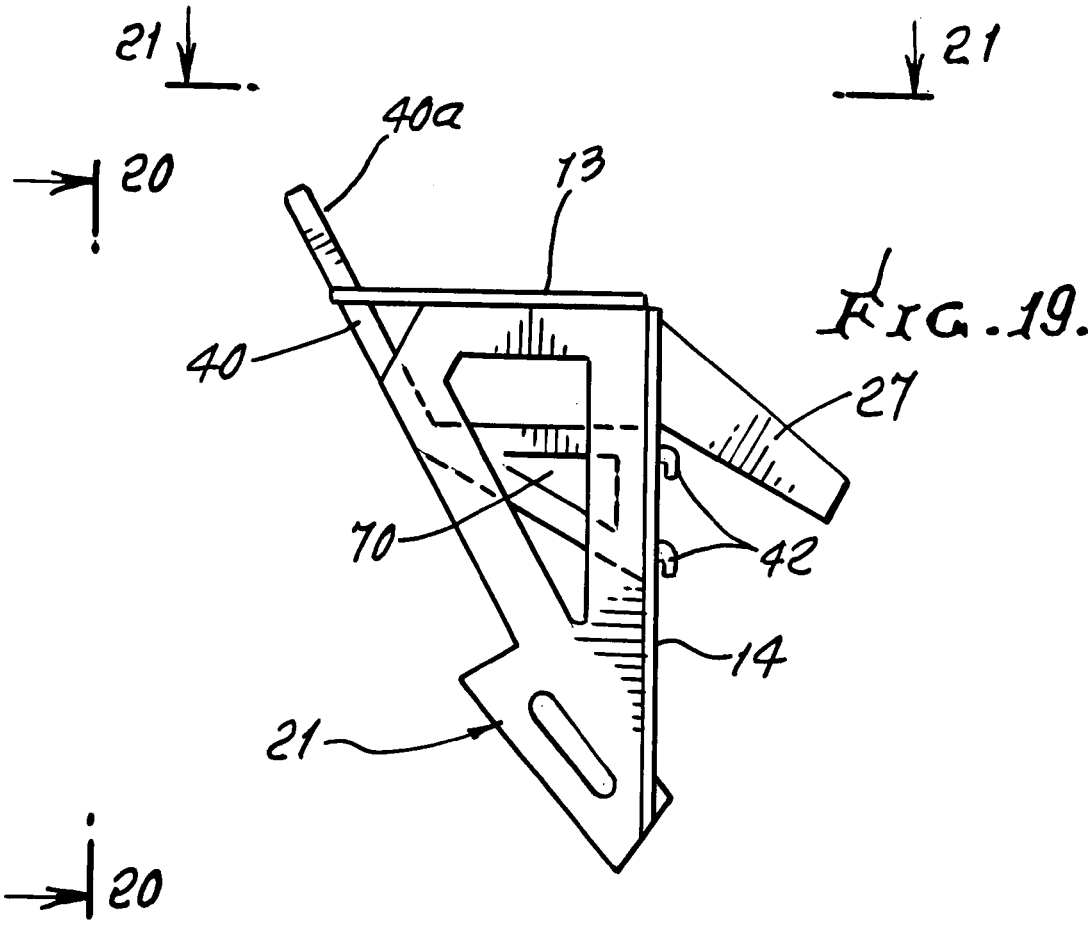
FIGS. 19-22 are views like FIGS. 11-14, but also showing the brace D installed in the illustrated assemblies.
Figure 20:
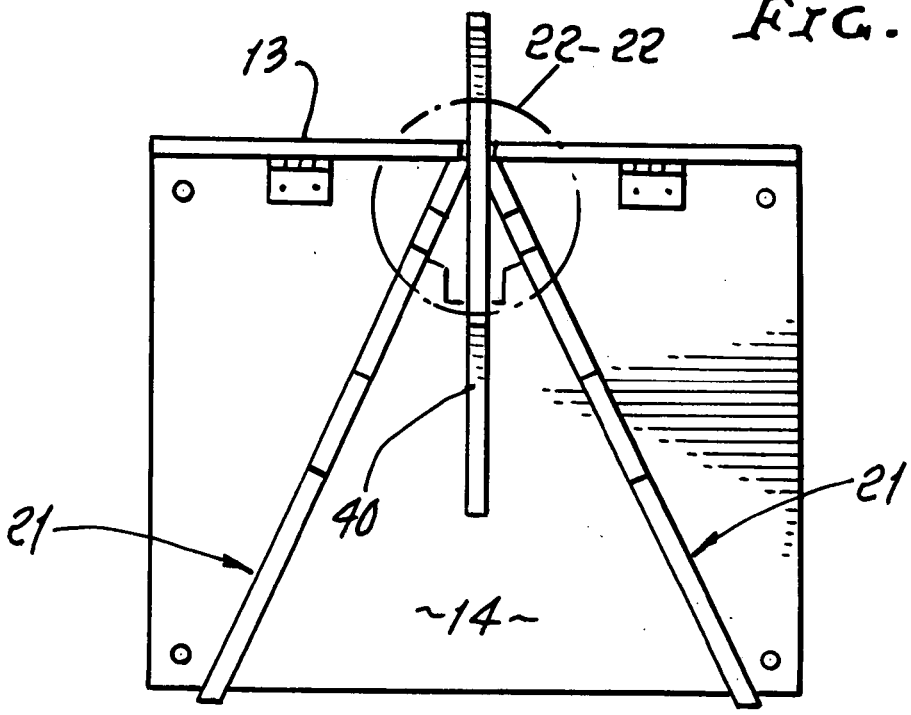
Figure 21:
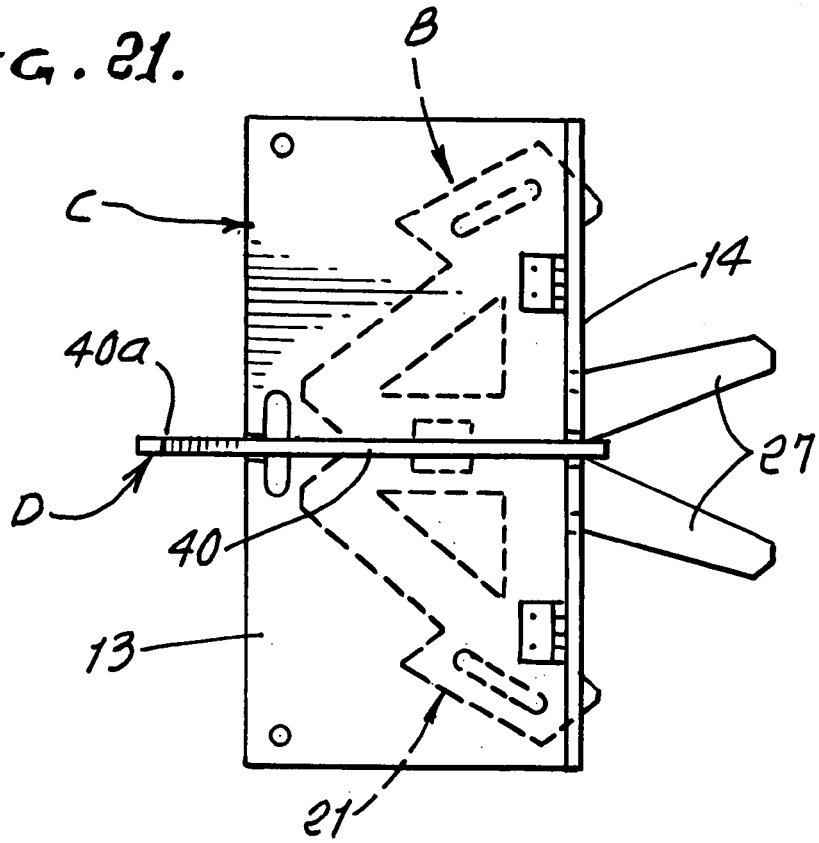
Figure 22:
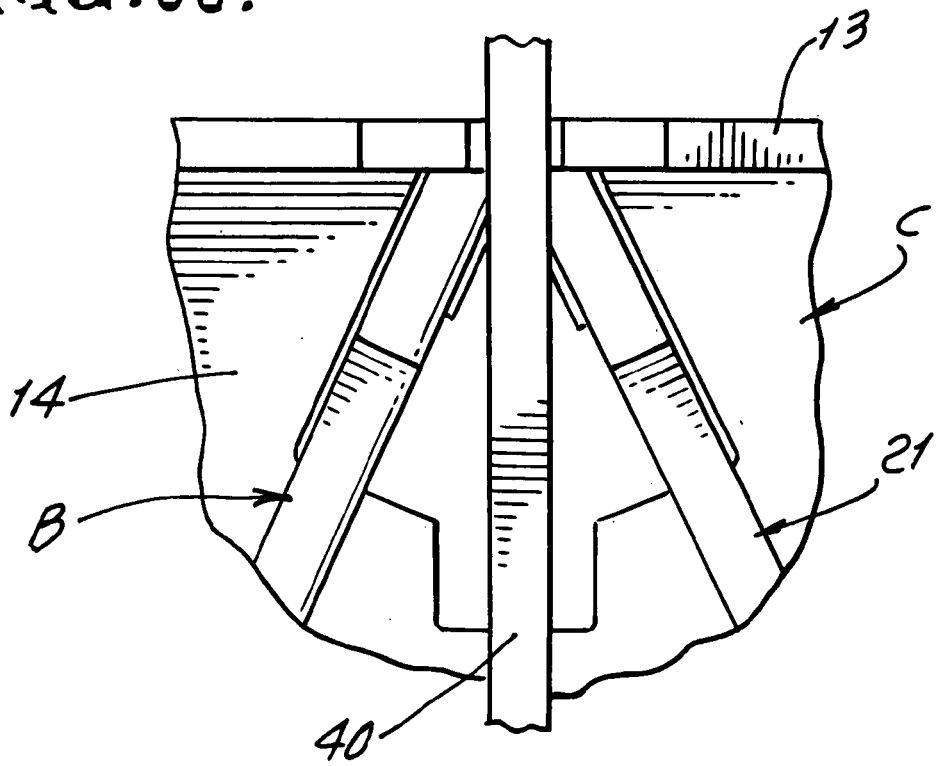
Figure 23:
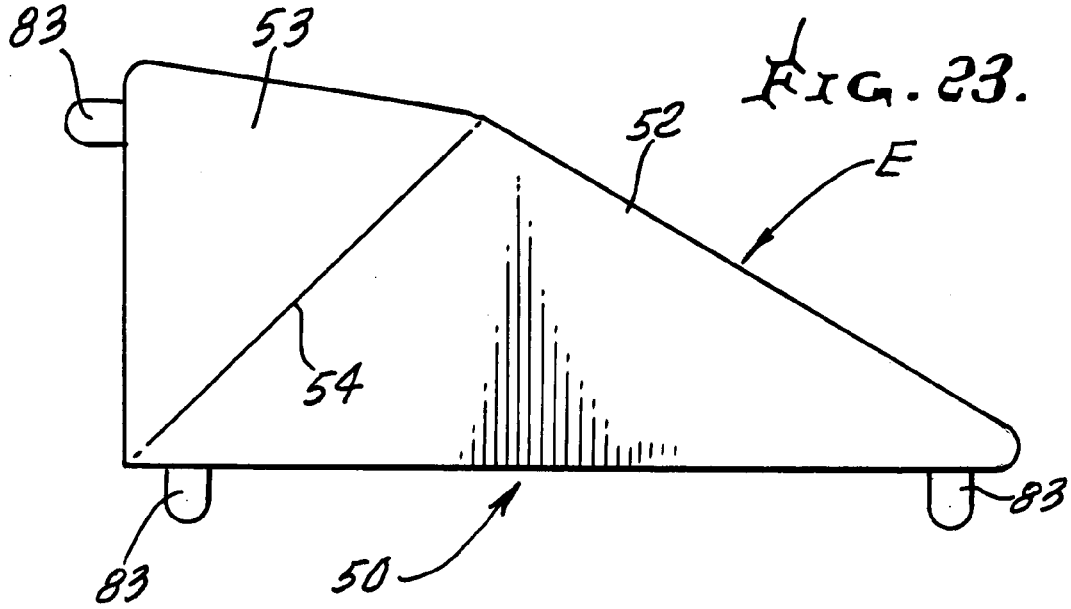
FIG. 23 is a side view showing a side panel configuration, as also seen in FIG. 1.
Figure 24:
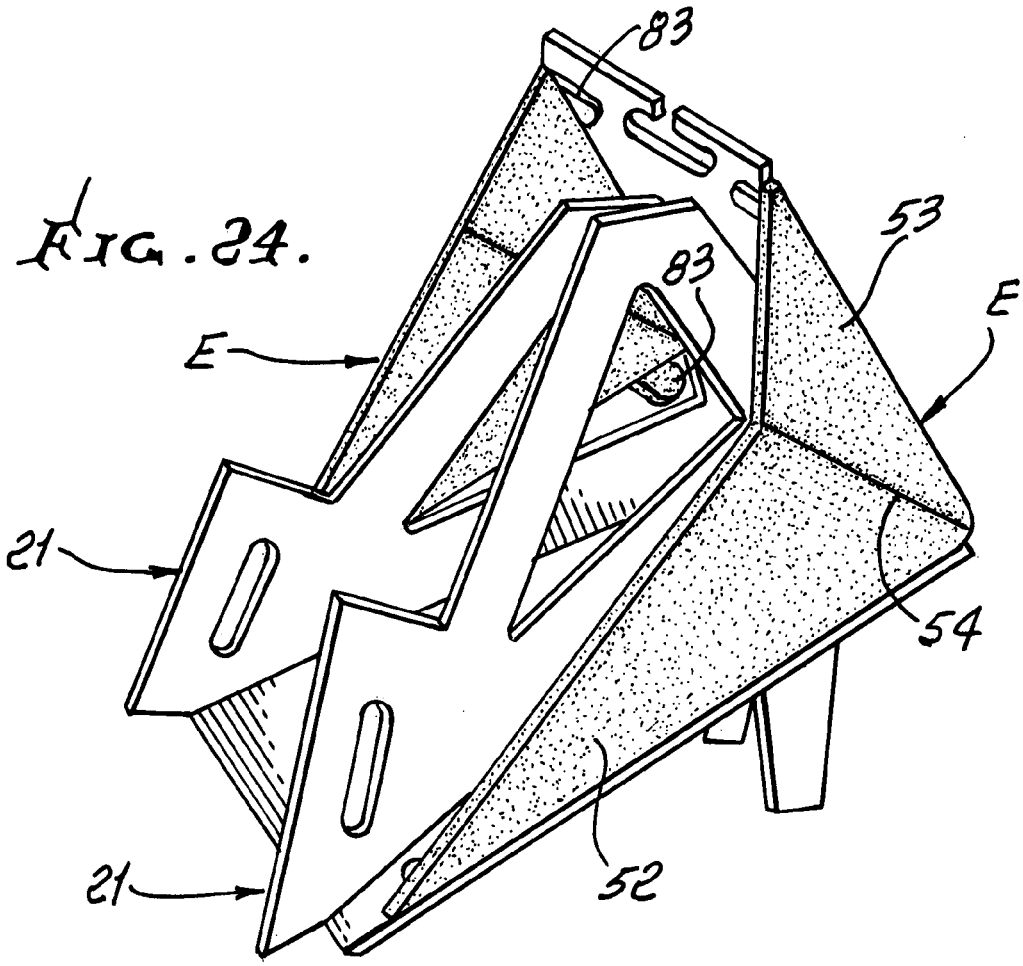
FIG. 24 is a view like FIG. 1, but showing the side panels E in shaded configuration, the brace B being omitted.

FIGS. 1-4 show sound controlling apparatus 10 adapted for combination with a speaker unit 11 that forms a box-like enclosure. Sound emitted rearwardly from a loudspeaker 12 within the unit 11 (see arrows 19 in FIG. 4) is to be reflected from an upper panel 13 (see arrows 19 in FIG. 4) and downwardly forwardly toward a lower panel 14, from which sound is again reflected forwardly from the apparatus 10. Panel 13 is inclined upwardly and forwardly from a horizontal hinged connection 15 to panel 14. Panel 14 is inclined downwardly and forwardly from connection 15, to extend beneath speaker unit 11, whereby a sound travel channel is formed rearwardly of and below the unit 11. Panels 13 and 14 are together designated by the letter (C). FIGS. 8-10 show the edge hinged construction of the sound reflecting panels 13 and 14 enabling their collapse for transport.

A stand 20 is provided to support the speaker unit 11 in inclined position, as shown. The stand includes two like generally upright panel sections 21, also designated at B, having upper edges 23 and 24 that seat the bottom and rear walls of the unit 11, in cradled condition. Short edge 23 is inclined upwardly and forwardly, and long edge 24 is inclined upwardly and rearwardly, the two edges intersecting at 25 to form a 90 degree intersection. Panel sections 21 have forward and rearward legs 26 and 27 that project downwardly to seat the assembly. Legs 27 of the convergent sections 21 project downwardly through an opening 28 in panel 14, and located near hinged connection 15. See FIGS. 8 and 11-14. Legs 26 project downwardly through slots 29 in panel 14. A notch 30 in each section 21 receives a lip 31 of panel 14. See also FIG. 15. Side through openings 32 in the sections 21 pass sound laterally from the sound flow channel beneath the unit 11, for mixing.

Figure 1:
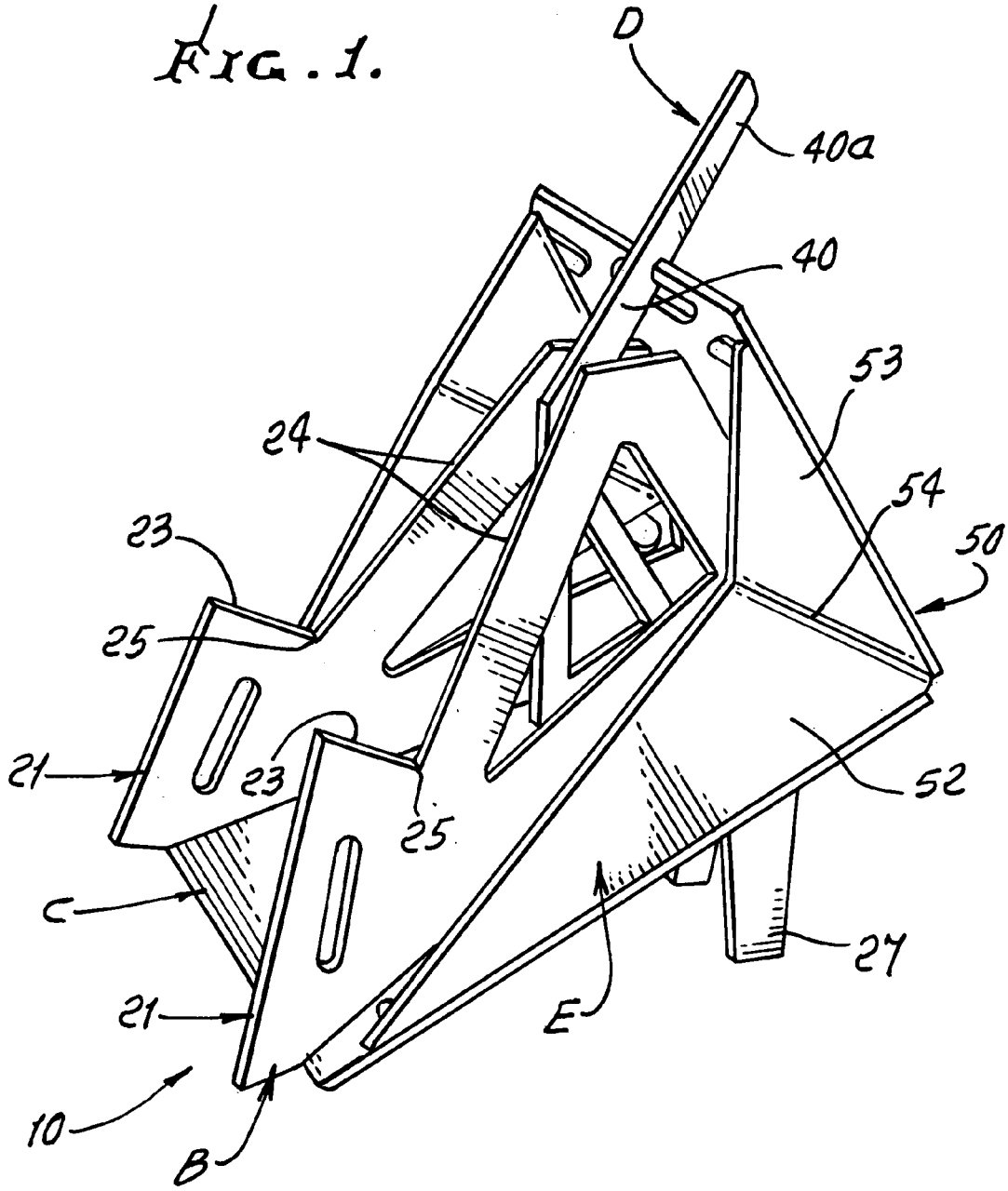
FIG. 1 is a perspective view showing sound controlling apparatus incorporating the invention, and in operating condition.
Figure 2:
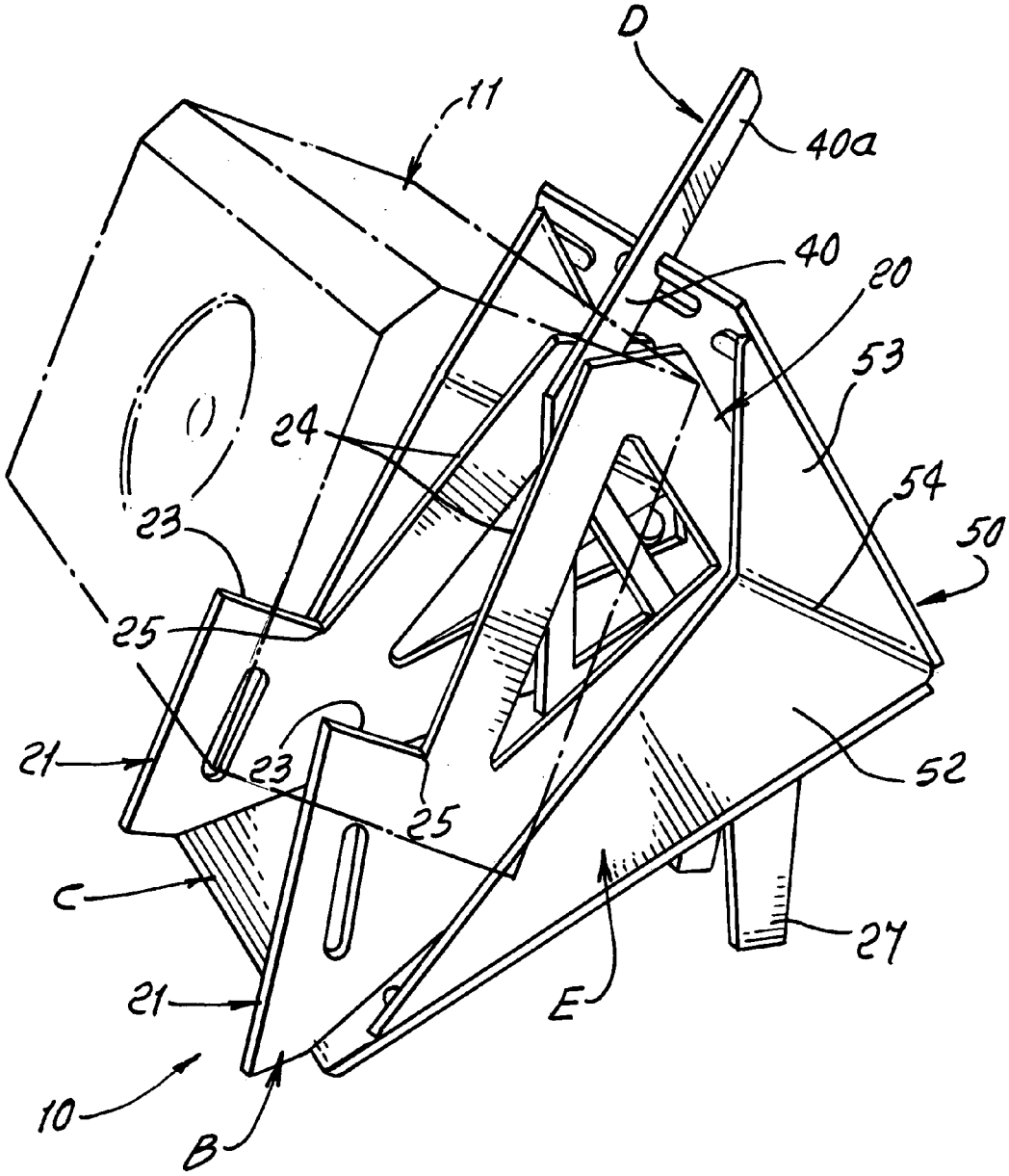
FIG. 2 is a view like FIG. 1 showing the outlines of a speaker and amplifier unit in place on the FIG. 1 apparatus.
Figure 3:
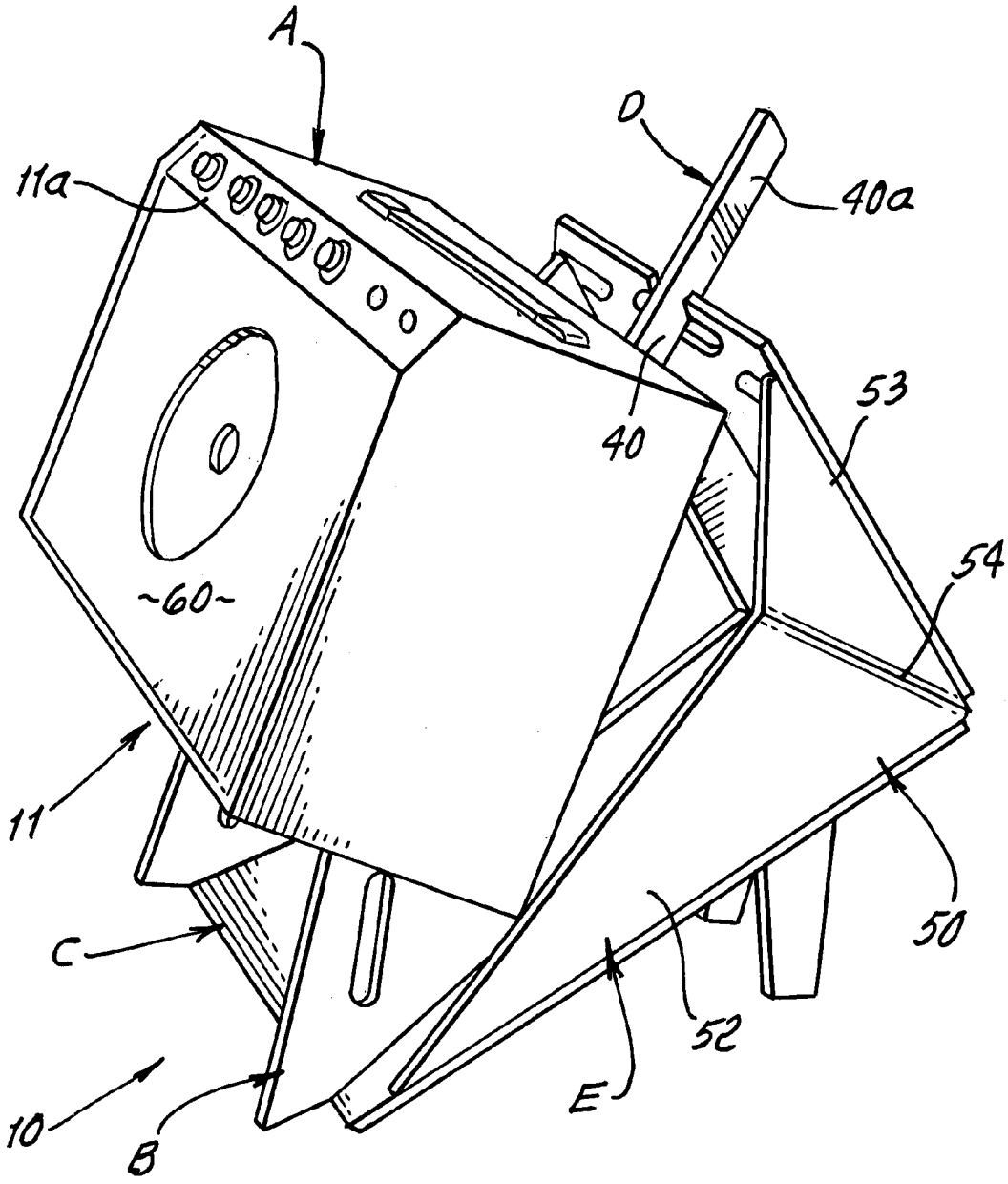
FIG. 3 is a view like FIG. 2, showing the speaker and amplifier unit in place on the FIG. 1 apparatus.

A brace 40 for the stand is employed as seen in FIG. 1, between panel sections 21 and protruding rearwardly at 40*a*, via a slot 41 in panel 13. The brace has two L-shaped lower projections 42 to fit in openings 43 in the lower panel 14, and seen in FIG. 8. Panel 14 also has two angled slots 29 that receive lower edge portions sections 21. See FIGS. 8 and 11. (D) also designates the brace.

Two side panels 50 are also provided to sidewardly enclose the sound channels, at opposite sides of the support panels sections 21. They are also designated at (E) and are seen to extend upwardly from outer edges of the lower panel 14. Each side panel includes triangular portions 52 and 53 having hinged interconnection at 54, so as to reflect and direct sound forwardly and upwardly at opposite sides of the reversing sound channel. Tabs 83 connect 50 to 13 and 14. See FIGS. 23 and 24. Portions 52 and 53 also extend (incline) toward panel sections 21, but are spaced from the latter to form upward openings, above the rearwardly extending sound channel designated by the arrows in FIG. 4. Accordingly, sound emitted from 10 toward panel 13 is reflected by 13, 14, 52 and 53 to travel forwardly and upwardly about the sides of 10, to combine with sound emitted at 59 from the front side 60 of the speaker unit, producing an amplified and full bodied effect, greater than that produced by 10 in the absence of 11. Brace 40 also has a sound passing through opening 70. See FIG. 17.

The apparatus is easily disassembled and collapsed, for transport.

We claim:

1. A sound controlling apparatus adapted for combination with a speaker unit, comprising a) a stand configured to support the speaker unit, b) a reflecting panel or panels associated with the stand to reflect sound waves transmitted by the speaker unit, said panel or panels having substantially triangular peripheries, c) the stand including two generally upright panel sections, with upper edges configured to support the speaker unit, said stand panel sections spaced apart to define a reflected sound transmission path therebetween d) the two stand panel sections being flat and extending in converging relation in a direction toward a reflecting panel, e) there being a flat brace located between the two upright stand panel sections and extending proximate and between the closest converging locations of the stand panel sections, to also intersect a reflecting panel, f) the brace having an upwardly and angled extension above the top levels of the two convergent stand sections, for supporting the reflecting panel, g) the two convergent stand sections being notched to interfit and support the speaker unit, h) there being a reflected sound divergent transmission path or paths defined by and between the upright panel sections and brace.

2. The apparatus of claim 1 wherein the stand panel sections have support legs.

3. The apparatus of claim 1 wherein the stand panel sections have through openings to transmit sound sidewardly between at least two of said transmission paths.

4. The apparatus of claim 1 wherein there are at least two side panels, the two stand panel sections located between and spaced from said side panels.

5. The apparatus of claim 1 wherein said reflecting panel or panels include a first reflecting panel to reflect sound waves directly directed at the first panel, and a second reflecting panel to reflect sound waves reflected from the first panel.

6. The apparatus of claim 5 wherein the first and second reflecting panels have hinged interconnection.

7. The apparatus of claim 4 wherein there is hinged interconnection between panel sections defined by a side panel.

8. The apparatus of claim 1, including said speaker unit carried by said stand.

9. The apparatus of claim 1 wherein the panel sections have legs projecting through openings in a reflecting panel.

* * * * *